US009244405B2

(12) United States Patent
Maruyama et al.

(10) Patent No.: US 9,244,405 B2
(45) Date of Patent: Jan. 26, 2016

(54) IMAGE FORMING APPARATUS

(71) Applicant: Brother Kogyo Kabushiki Kaisha, Nagoya-shi, Aichi-ken (JP)

(72) Inventors: Yasuhiro Maruyama, Kasugai (JP); Akihiro Kobayashi, Inazawa (JP); Tomoaki Hazeyama, Yokkaichi (JP); Naoyuki Iwata, Kakamigahara (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/231,030

(22) Filed: Mar. 31, 2014

(65) Prior Publication Data

US 2015/0093163 A1 Apr. 2, 2015

(30) Foreign Application Priority Data

Sep. 30, 2013 (JP) ..... 2013-203247

(51) Int. Cl.
*G03G 15/20* (2006.01)

(52) U.S. Cl.
CPC ..... *G03G 15/2053* (2013.01); *G03G 15/2025* (2013.01); *G03G 2215/2035* (2013.01)

(58) Field of Classification Search
CPC ..... G03G 15/2025; G03G 15/2017; G03G 15/2075; G03G 15/2053
USPC ..... 399/329
See application file for complete search history.

(56) References Cited

U.S. PATENT DOCUMENTS

| | | | | |
|---|---|---|---|---|
| 7,805,102 | B2 | 9/2010 | Kato | |
| 2008/0187372 | A1 | 8/2008 | Kato | |
| 2009/0052958 | A1 * | 2/2009 | Okuno et al. | 399/329 |
| 2009/0175645 | A1 | 7/2009 | Seol | |
| 2011/0150543 | A1 * | 6/2011 | Fujiwara et al. | 399/328 |

FOREIGN PATENT DOCUMENTS

| | | | |
|---|---|---|---|
| JP | 02043134 A | * | 2/1990 |
| JP | 2008-146964 A | | 6/2008 |

* cited by examiner

*Primary Examiner* — Erika J Villaluna
(74) *Attorney, Agent, or Firm* — Banner & Witcoff, Ltd.

(57) ABSTRACT

An image forming apparatus may include a main body having a surface. The main body may accommodate a photosensitive member disposed away from the surface and along a conveying path and a fuser. The fuser may be disposed downstream from the photosensitive member along the conveying path and have a portion disposed further away from the surface than the photosensitive member. The fuser may include an endless belt and a nip plate. The nip plate may include a first surface with lubricant thereon that faces an inner surface of the endless belt, and a second surface that extends from an end of the first surface. The second surface may be spaced apart from the inner surface of the endless belt and include a furthest downstream portion of the nip plate.

24 Claims, 8 Drawing Sheets

IMAGE FORMING APPARATUS

CROSS REFERENCE TO RELATED APPLICATION

This application claims priority from Japanese Patent Application No. 2013-203247, filed on Sep. 30, 2013, the entire subject matter of which are incorporated herein by reference.

BACKGROUND

1. Field

Aspects of the present invention relate to an image forming apparatus in an electrophotographic method and to a fuser of the image forming apparatus, and more particularly to an image forming apparatus equipped with a fuser in a belt fixing method.

2. Description of the Related Art

In general, an image forming apparatus in an electrophotographic method includes an image supporting body structured so that a developing agent such as toner can be supported, a transfer member that transfers the developing agent supported on the image supporting body to a recording sheet, and a fuser that thermally fixes the developing agent transferred to the recording sheet. In a known method used by a fuser, an endless belt (fixing film) is held between a nip member placed so as to face the inner surface of the belt and a rotating body (pressurizing roller) placed so as to face the outer surface of the belt, after which the developing agent is heated to melt it and the melted developing agent is fixed on the recording sheet in a process in which the recording sheet on which the developing agent is supported is conveyed while being held between the belt and the rotating body.

As for a fuser based on this method, a structure is known in which fluid guide grooves are formed in a surface, of the nip member, that is in contact with the belt to evenly distribute a lubricant used to enhance slidability between the nip member and the belt.

Because of design considerations for a recording sheet conveying path in the image forming apparatus, the nip member and rotating body are placed so that the contact portion of the nip member faces downward as in Japanese Unexamined Patent Application Publication No. 2008-146964. In addition to this aspect, an aspect in which the contact portion of the nip member is oriented at an angle as indicated in FIG. 1 in U.S. patent publication no. 2009/0175645 has been practiced.

In the structure described in Japanese Unexamined Patent Application Publication No. 2008-146964, a lubricant can be evenly distributed on the contact portion of the nip member, but there is no consideration for the lubricant flowing outwardly from the contact portion. If the lubricant flows outwardly from the contact portion, the lubricant may proceed along the smooth surface of the nip member and may turn back and enter the back of the nip member. As a result, the lubricant may contaminate the interior of the apparatus. In addition, if the amount of lubricant is reduced due to its outward flow, the slidability of the belt may be reduced. Then, the driving torque of the belt may be increased and the belt becomes more likely to slip. Furthermore, the apparatus may be deteriorated earlier than expected.

Particularly in the structure described in U.S. patent application No. 2009/0175645, in which the contact portion of the nip member is oriented at an angle, if the lubricant overflows from the contact portion of the nip member and enters the interior of the fusing device from the downstream end of the nip member, the lubricant may contaminate a heating element, a reflecting plate, which reflects radiant heat from the heating element, and other components in the fuser. This may lower the performance of the fuser.

Noting the issue of suppressing a lubricant from flowing out from the upwardly oriented contact portions of the nip member and other members in a fuser, particularly from the downstream end of the contact portion in a direction in which a recording sheet is conveyed (belt sliding direction), the inventors of this application repeated diligent study and devised the present invention.

SUMMARY

According to the aspects of the disclosure, an image forming apparatus may include a main body having a bottom surface, a photosensitive drum away from the bottom surface, and a fuser having at least a portion disposed further away from the bottom surface than the photosensitive drum. The fuser may include an endless belt, a rotatable body, and a nip plate. The nip plate may include a first surface with lubricant thereon that faces an inner surface of the endless belt, and the second surface that extends from an end of the first surface. The first surface and the rotatable body may be configured to nip the endless belt there between, and the endless belt and the rotatable body may be configured to form a nip therebetween. The second surface may include the furthest downstream portion of the nip plate along the conveying path and may be spaced away from the inner surface of the endless belt.

According to other aspects of the disclosure, an image forming apparatus may include a main body having a bottom surface, a photosensitive body away from the bottom surface, and a fuser disposed further away from the bottom surface than the photosensitive body. The fuser may include an endless belt, a rotatable body, and a nip plate. The nip plate may include a first surface with lubricant thereon that faces an inner surface of the endless belt, and the second surface that extends from an end of the first surface. The first surface and the rotatable body may be configured to nip the endless belt there between, and the endless belt and the rotatable body may be configured to form a nip therebetween. The endless belt may be configured to move in a moving direction at the nip. The second surface may include the furthest downstream portion of the nip plate in the moving direction and may be spaced away from the inner surface of the endless belt.

According to still other aspects of the disclosure, an image forming apparatus may include a main body having a bottom surface, a photosensitive body away from the bottom surface, and a fuser disposed further away from the bottom surface than the photosensitive body. The fuser may include an endless belt, a rotatable body, and a nip forming assembly. The nip forming assembly may include a first surface with lubricant thereon that faces an inner surface of the endless belt, and the second surface that extends from an end of the first surface. The first surface and the rotatable body may be configured to nip the endless belt therebetween, and the endless belt and the rotatable body may be configured to form a nip therebetween. The endless belt may be configured to move in a moving direction at the nip. The second surface may include a downstream end in the moving direction and may be spaced away from the inner surface of the endless belt.

DETAILED DESCRIPTION

Figure 1:
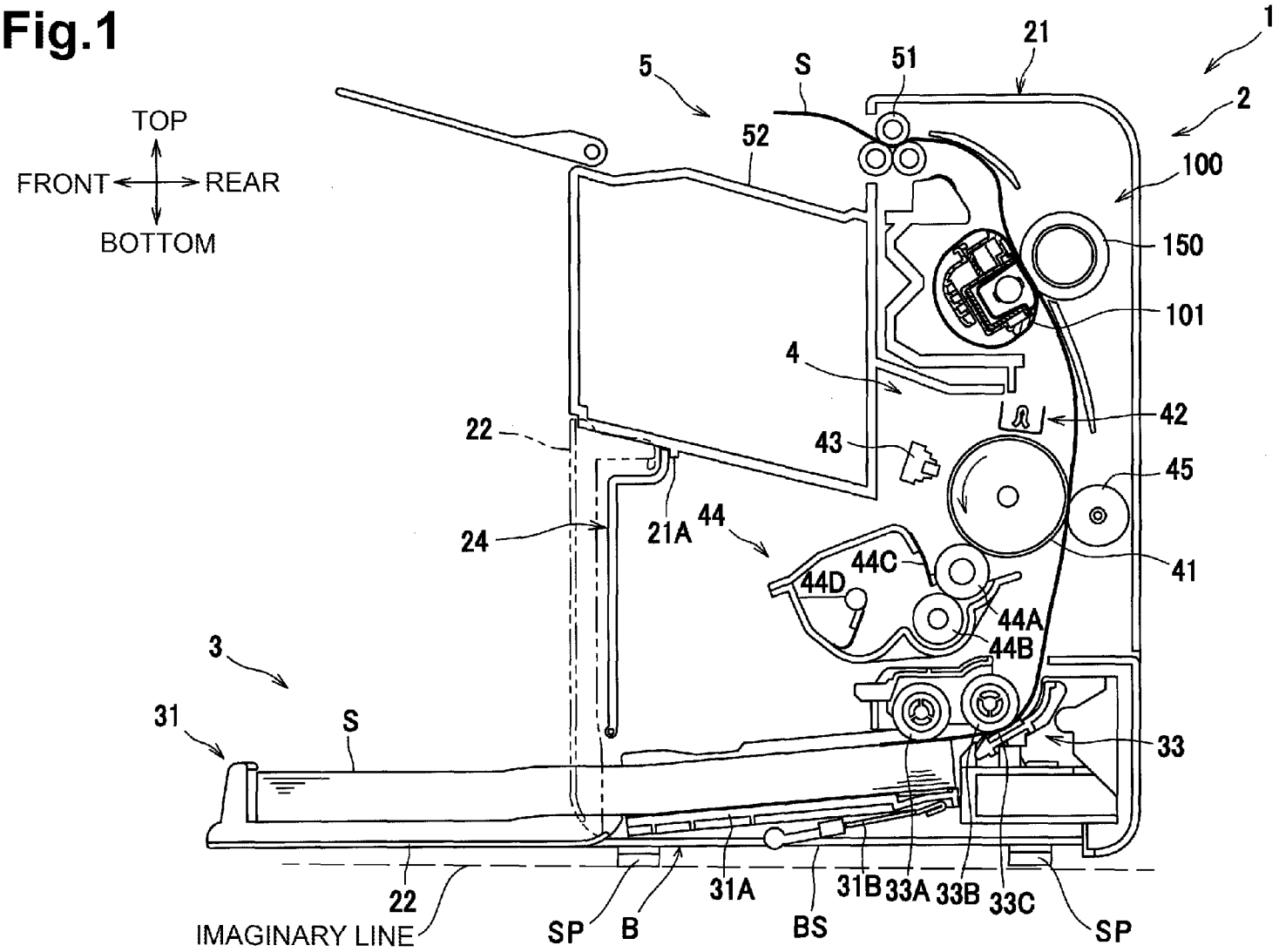
FIG. 1 illustrates the entire structure of a laser printer taken as an example of an image forming apparatus in an embodiment.

An illustrative embodiment of the present invention will be described with reference to the drawings at appropriate points. In the descriptions below, directions are determined with respect to the user who uses the image forming apparatus. Specifically, the left side in FIG. 1, which is the front when viewed from the user, is the front; the right side in FIG. 1, which is the back when viewed from the user, is the back; a side in front on the drawing sheet in FIG. 1 is the right side; a side in back on the drawing sheet in FIG. 1 is the left side; the vertical direction in FIG. 1 is the vertical direction.

First, the entire structure of an image forming apparatus in an illustrative embodiment will be described.

As illustrated in FIG. 1, the laser printer 1, which is an example of an image forming apparatus, forms an image on a sheet S, which is an example of a recording sheet, by transferring a toner (developing agent) image formed on a photosensitive drum 41, as an example of a photosensitive body, described later to the sheet S. The laser printer 1 mainly includes a case 2, a sheet feeding unit 3, an image forming unit 4, and a discharge unit 5.

The case 2 is mainly structured with a main body 21, which supports the photosensitive drum 41 and the like, and a front cover 22. The main body 21 has a bottom B that has a bottom surface (BS). The main body 21 has a plurality of supports (SP), each of the plurality of supports (SP) protruding from the bottom surface (BS). Each of the plurality of supports (SP) is softer than the bottom and includes gum. An imaginary line is tangent to a bottom surface of two of the plurality of supports (SP). In other words, the support (SP) is a foot. The main body 21 has an opening 21A in the front surface. A development cartridge 44 described later is attached and removed through the opening 21A.

The front cover 22, which covers the opening 21A on the front side as indicated by the dash-dot-dot lines, is supported so that the upper end of the front cover 22 can swing around its lower end with respect to the main body 21. While being open as indicated by the solid lines, the front cover 22 is part of a feed tray 31 described later. The case 2 has a second front cover 24, which is placed inside the front cover 22 in the closed state indicated by the dash-dot-dot lines. The second front cover 24 opens and closes the opening 21A by swinging around its lower end. Thus, even while the front cover 22 is open and is being used as part of the feed tray 31, the second front cover 24 can suppress dust from entering the interior of the case 2.

The sheet feeding unit 3, which is structured so as to supply the sheet S to the image forming unit 4, mainly includes the feed tray 31 and a sheet feeding mechanism 33. The feed tray 31 is a tray on which sheets S to be fed to the image forming unit 4 are stacked.

The feed tray 31 is formed with a pressing plate 31A disposed at the bottom in the case 2 and a base used together with the front cover 22 in the open state to allow sheets S to be stacked. The pressing plate 31A is supported so that its rear end can vertically swing around its front end with respect to the main body 21. The rear end is lifted by a lifting member 31B.

The sheet feeding mechanism 33 includes a pickup roller 33A, a separating roller 33B, a separating pad 33C, and the like. The sheet feeding mechanism 33 is placed near the back at the bottom in the case 2. In the sheet feeding mechanism 33, the pickup roller 33A feeds sheets S stacked on the feed tray 31, and the sheets S are separated between the separating roller 33B and the separating pad 33C and are fed to the image forming unit 4 one sheet S at a time.

The image forming unit 4 is structured so as to form an image on a fed sheet S. It mainly includes the photosensitive drum 41, which is an example of an image supporting body, a charging unit 42, an exposing unit 43, a development cartridge 44, a transfer roller 45, which is an example of a transfer member, and a fuser 100.

The photosensitive drum 41 is formed by forming a photosensitive layer on the outer circumferential surface of a cylindrical conductive drum body. The photosensitive drum 41 is placed near the back in the case 2 in the vicinity of the vertical center so as to be rotatable in the direction indicated by the arrow in FIG. 1. When toner (developing agent) is supplied to an electrostatic latent image formed by an exposure, a toner image as an example of a developing agent image is formed. The photosensitive drum 41 supports the toner image.

The charging unit 42, which includes corona wires and grid electrodes, is placed so as to face the top of the photosensitive drum 41. The charging unit 42 evenly charges the surface of the photosensitive drum 41 by applying a charging bias to the surface.

The exposing unit 43 includes a plurality of turned-on and turned-off parts (not illustrated), which are light emitting diodes, arrayed in the right and left direction, in which the axis of the photosensitive drum 41 rotates. The exposing unit 43 is placed so as to face a forward and upper portion of the photosensitive drum 41. The exposing unit 43 enables the charged surface of the photosensitive drum 41 to be exposed to light by turning on and off the turned-on and turned-off parts according to image data.

The development cartridge 44 includes a developing roller 44A, a supply roller 44B, a layer thickness restricting blade 44C, a toner storage 44D in which toner is stored, and the like. The development cartridge 44 is placed so as to face a forward and lower portion of the photosensitive drum 41. The development cartridge 44 supplies toner to the electrostatic latent image formed on the photosensitive drum 41 by an exposure so that a toner image is formed on the photosensitive drum 41. With the front cover 22 and second front cover 24 in the open state, the development cartridge 44 can be attached to and removed from the case 2 through the opening 21A, enabling the development cartridge 44 to be replaced.

The transfer roller 45 includes a metal axis, an elastic roller body formed around the axis, and the like. The transfer roller 45 is placed so as to face the back of the photosensitive drum 41. The transfer roller 45 applies a transfer bias to draw toner and transfer a toner image to a sheet S passing between the transfer roller 45 and the photosensitive drum 41.

The fuser 100 includes a heating member 101, a pressurizing roller 150, and the like. The fuser 100 is placed above the photosensitive drum 41 in the case 2. The fuser 100 thermally fixes the toner image transferred to the sheet S passing between the heating member 101 and the pressurizing roller 150. The structure of the fuser 100 will be described later in detail.

The discharge unit 5 mainly includes a discharge roller 51 and a discharge tray 52 to discharge the sheet S on which an image has been formed. Specifically, the discharge roller 51 discharges, to the outside of the case 2, the sheet S on which an image has been formed and conveyed from the fuser 100. The discharge roller 51 is placed at an upper portion in the interior of the case 2. The discharge tray 52 accepts the sheet S discharged to the outside of the case 2. The discharge tray 52 is placed on the upper surface of the main body 21.

When receiving a command, including image data, to form an image, the laser printer 1 structured as described above executes an image forming operation. Specifically, in the image forming unit 4, the charging unit 42 charges the surface of the photosensitive drum 41, which is rotationally driven, after which the exposing unit 43 exposes the charged surface of the photosensitive drum 41 to light to form an electrostatic latent image on the photosensitive drum 41 according to the image data. Then, the image forming unit 4 supplies toner from the development cartridge 44 to the exposed photosensitive drum 41 so that the electrostatic latent image is visualized, forming a toner image on the photosensitive drum 41.

The sheet feeding mechanism 33 in the sheet feeding unit 3 supplies a sheet S placed on the feed tray 31 to the image forming unit 4 at an appropriate timing before the toner image is formed. The image forming unit 4 conveys the sheet S supplied from the sheet feeding unit 3 between the photosensitive drum 41 and the transfer roller 45 so that the toner image supported on the photosensitive drum 41 is transferred to the sheet S. The image forming unit 4 then causes the fuser 100 to thermally fix the toner image transferred to the sheet S. The discharge unit 5 causes the discharge roller 51 to discharge the sheet S on which the toner image has been thermally fixed to the outside of the case 2 so that the sheet S is placed on the discharge tray 52.

Detailed Structure of the Fuser

The structure of the fuser 100 will be described next in detail.

Figure 2:
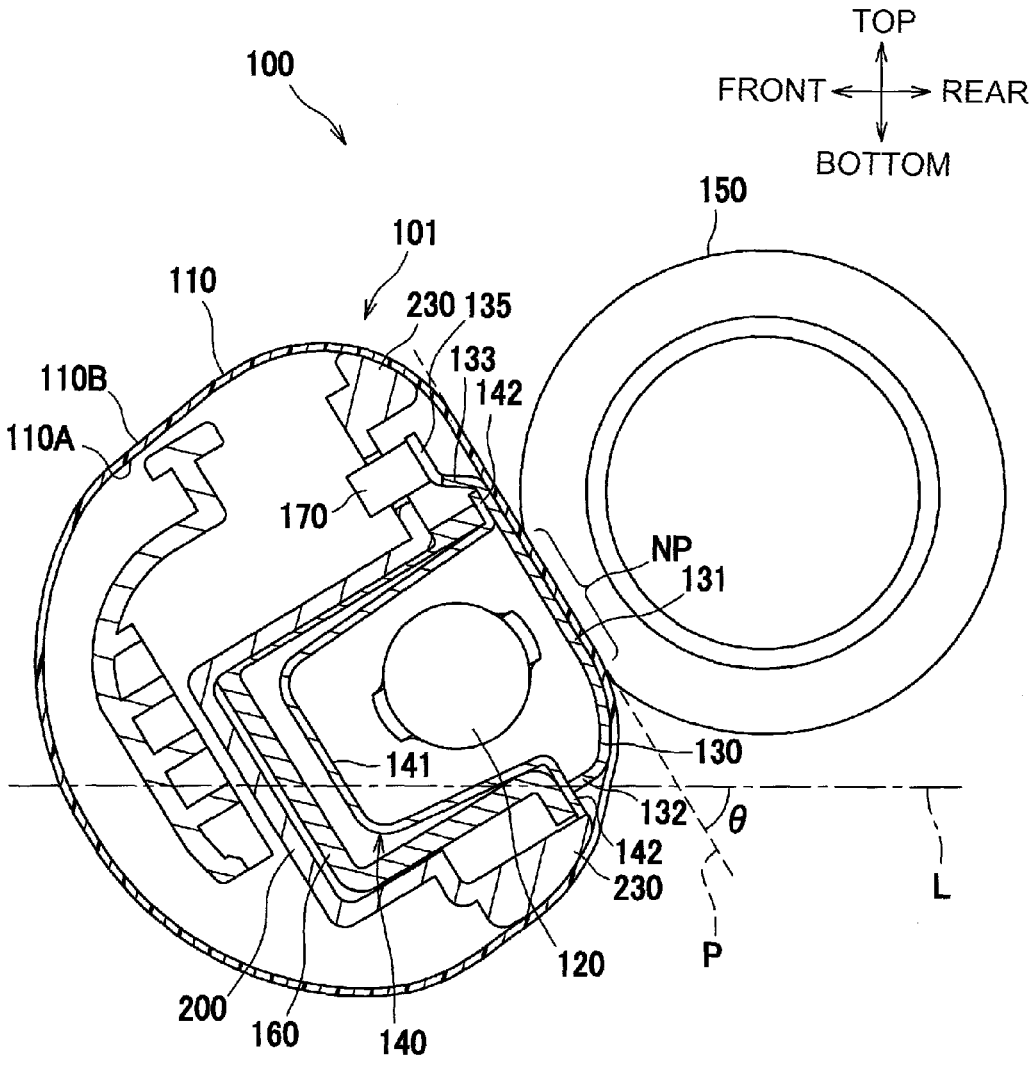
FIG. 2 is a cross sectional view of a fuser.

As illustrated in FIG. 2, the fuser 100 includes the heating member 101 and the pressurizing roller 150 as an example of rotatable body. The nip plate 130 and the pressurizing roller 150 nip the endless belt 110 therebetween, and The nip plate 130 and the endless belt 110 form a nip (NP) therebetween. The endless belt 100 is configured to move in a moving direction (MV) at the nip (NP). The heating member 101 includes an endless belt 110, which is an example of an endless belt, a halogen lamp 120, which is an example of a heater, a nip plate 130, which is an example of a nip member, a reflective plate 140, a stay 160, and a guide frame 200. The nip plate 130 and part (a guide 230) of the guide frame 200 form a nip forming assembly that has a contact portion placed so as to come into contact with the inner surface of the endless belt with a lubricant intervening therebetween and forms a desired nip NP between the pressurizing roller 150 and the nip forming assembly by guiding an endless belt 110 sliding on a conveyance path of the sheet S. The nip plate includes a metal plate.

The endless belt 110 is an endless belt having heat resistance and flexibility. When the endless belt 110 is driven by the pressurizing roller 150, which rotates clockwise on the drawing, while in contact with it, the endless belt 110 moves forward and upward from below on a side (nip portion) on which the sheet S is held between the pressurizing roller 150 and the endless belt 110. The endless belt 110 rotates around an axial line extending in the right and left direction (width direction of the endless belt 110). The inner surface 110A of the endless belt 110 slides on the nip plate 130 and its external surface 110B faces the pressurizing roller 150. The endless belt 110 has a metal element tube made of a metal such as stainless steel. The endless belt 110 may also have a rubber layer that covers the surface of the metal element tube, and may further have a non-metal easy-to-peel material layer formed by, for example, forming a fluorine coating so as to cover the surface of the rubber layer.

The halogen lamp 120, which is separated from the nip plate 130, is a heat generating body that heats the nip plate 130 and endless belt 110 to heat toner on the sheet S. The halogen lamp 120 is placed inside the endless belt 110 at prescribed distances from the inner surfaces of the endless belt 110 and nip plate 130.

The nip plate 130 is an elongated metal plate extending in the right and left direction. It is formed by bending, for example, an aluminum plate, which has a higher heat conductivity than a stay 160, described later, made of steel. The nip plate 130 is placed so as to come into contact with the inner surface 110A of the endless belt 110. The nip plate 130 receives radiant heat from the halogen lamp 120 and transmits the received heat through the endless belt 110 to toner on the sheet S. The structure of the nip plate 130 will be described later.

The reflective plate 140 reflects radiant heat that has been emitted from the halogen lamp 120 mainly in the fore-and-aft direction and the upward direction toward the nip plate 130 (particularly, the inner surface of a base 131). The reflective plate 140 is placed inside the endless belt 110 at a prescribed distance from the halogen lamp 120 so as to enclose the halogen lamp 120.

When the radiant heat emitted from the halogen lamp 120 is collected to the nip plate 130 by the reflective plate 140 of this type, the radiant heat from the halogen lamp 120 can be used efficiently, so the nip plate 130 and endless belt 110 can be quickly heated.

The reflective plate 140 is formed by curving, for example, an aluminum plate having a large a reflection coefficient for near infrared rays and far infrared rays in a substantially U shape in a cross sectional view. To be more specific, the reflective plate 140 mainly includes a reflective part 141 having a curved shape (substantially U shape in a cross sectional view) and flanges 142, which are bent substantially perpendicularly toward the outside at both ends of the reflective part 141 and extend in the vertical direction. To increase the heat reflectivity of the reflective plate 140, it may be formed from, for example, a mirror-finished aluminum plate.

The stay 160 supports both ends of the base 131 of the nip plate 130 in the conveyance direction of the sheet S through the flanges 142 of the reflective plate 140, assuring the rigidity of the nip plate 130. The stay 160 is formed in a substantially U shape in a cross sectional view and is placed so as to cover the reflective plate 140.

The guide frame 200 supports a temperature sensor 170, which senses the temperature of the nip plate 130 to control the temperature of the fuser 100, and other parts. The guide frame 200 is secured to the stay 160. The temperature sensor 170 is disposed so as to face a temperature sensing tab 135, described later, of the nip plate 130. The temperature sensor 170 transmits, to a control unit (not illustrated), signals indicating temperatures sensed at various positions on the nip plate 130. The guide frame 200 includes guides 230 (guide members), which come into contact with the inner surface 110A of the endless belt 110 on the upstream side and downstream side of the nip plate 130.

The pressurizing roller 150 holds the endless belt 110 against the nip plate 130 of the heating member 101, drives the endless belt 110 with its rotation, and conveys the sheet S in the conveyance direction while the sheet S is being sandwiched between the pressurizing roller 150 and the endless belt 110.

In this embodiment, the nip plate 130 is placed so that its contact surface (contact portion) faces upward. Facing upward indicates not only an upward orientation in the vertical direction with respect to the gravity direction but also an upward orientation at an angle. Specifically, as illustrated in FIG. 2, the contact surface faces upward at an angle. An angle θ (elevation angle) between a horizontal plane L and a virtual plane P including the nip NP is usually at least 0 degree but not more than 90 degrees; in this embodiment, the angle θ is 60 degrees. The range of the angle θ may be from 20 to 85 degrees, from 30 to 80 degrees, from 50 to 70 degrees, or from 55 to 65 degrees.

Structure of the Nip Plate

Next, the structure of the nip plate 130 will be described in detail.

Figure 3A:
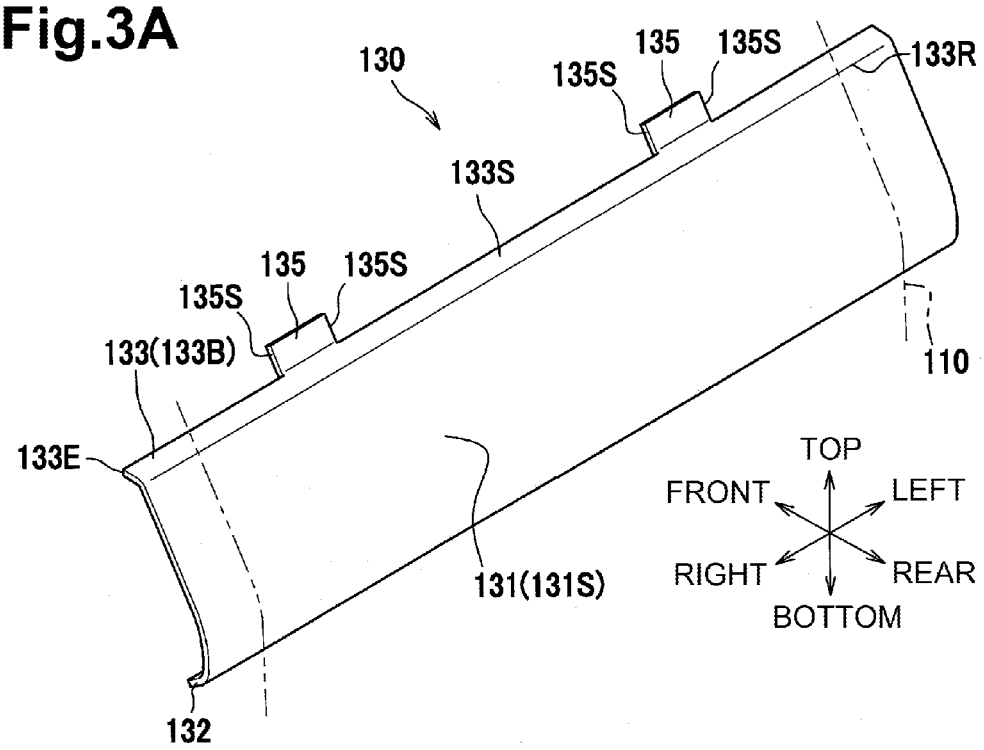
FIG. 3A is a perspective view illustrating an example of the structure of a nip plate.
Figure 3B:
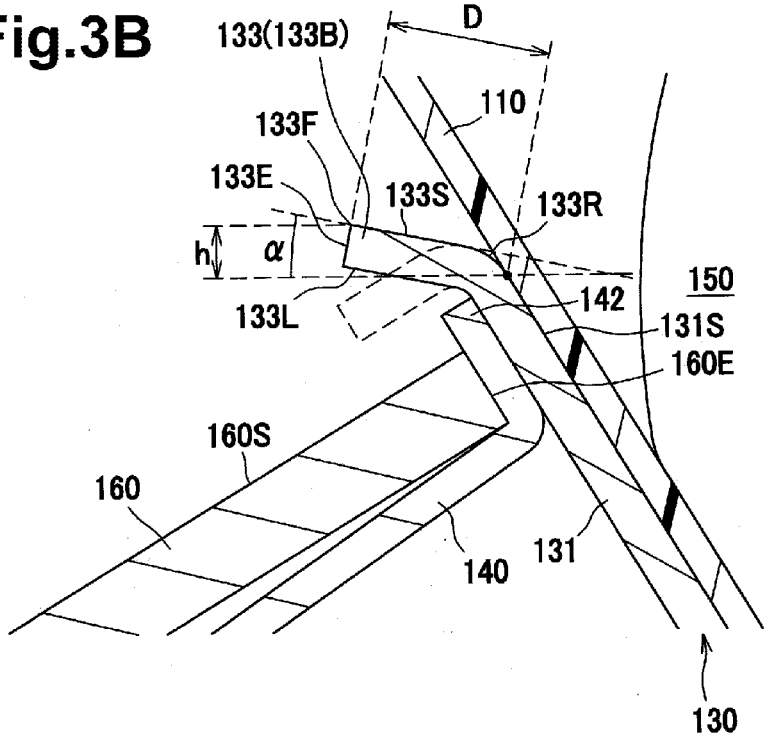
FIG. 3B is a cross sectional view illustrating a downstream portion of the nip plate and its vicinity in the fuser.

As illustrated in FIGS. 2, 3A, and 3B, the nip plate 130 mainly includes the base 131, which comes in contact with the inner surface 110A of the endless belt 110 with fluorine-based grease, fluorine oil, silicon oil, or another lubricant intervening therebetween as an example of a contact portion during driving, an upstream portion 132 and a downstream portion 133, which respectively extend from the upstream end and downstream end of the base 131 in a sliding direction, and temperature sensing tabs 135 formed like a rectangular protrusion at two places along the downstream portion 133. One temperature sensor 170 is disposed so as to face a temperature sensing tab 135. Temperature sensed at each position is used to control the fuser 100.

The nip plate 130 is bent at the upstream end and downstream end of the base 131 in the sliding direction in which the endless belt 110 slides. As illustrated in FIG. 3A, the upstream portion 132 extends from the upstream end of the base 131 in a direction away from the inner surface 110A of the endless belt 110. Similarly, the downstream portion 133 extends from the downstream end of the base 131 in a direction away from the inner surface 110A of the endless belt 110.

As illustrated in FIG. 3B, the downstream portion 133 is formed by bending the nip plate 130 at the downstream end of the base 131 through a smaller angle than a conventional downstream portion indicated by the broken lines. That is, unlike the conventional downstream portion, the downstream portion 133 is not inclined downward from a ridge 133R formed at the bent portion toward the downstream side. Instead, the downstream portion 133 is formed as an inclined portion 133B, which has an inclined surface 133S that is an example of a second surface, having an upward inclination from the ridge 133R, the inclination extending upward at an angle of a with respect to a horizontal plane. The inclined surface has an area which has a length as same as the width of endless belt.

In this embodiment, the whole downstream portion 133 functions as a wall (protrusion) with a height of h, the wall being placed so that the top end is at a position higher than the position of the bottom end. Even if the lubricant overflows from the base 131, therefore, the downstream portion 133 suppresses the lubricant from flowing out. In addition, since this wall is formed so that the inclined surface 133S continuously extends upwardly at an angle of a from the ridge 133R formed at the downstream end of the base 131 toward the downstream side, the wall returns, due to the gravity, the lubricant that is about to overflow from the downstream portion 133 to the base 131.

As described above, in this embodiment, a wall that suppresses a lubricant from flowing out can be easily formed by disposing the nip plate 130 so that its downstream portion 133 is at a distance from the endless belt 110 and by bending the nip plate 130 so that the downstream portion 133 extends upwardly at an angle, according to the orientation of the fuser 100.

In this embodiment, even if the lubricant overflows from the sliding surface 131S, that is an example of a first surface, of the nip plate 130 during the driving of the endless belt 110, it is possible to suppress the lubricant from flowing out from the inclined surface 133S of the downstream portion 133. Therefore, a problem can be efficiently avoided that, for example, the lubricant overflows from the top end 133F of the downstream portion 133, proceeds to the end surface 133E of the top end 133F and to a side surface 135S of the temperature sensing tab 135, turns back and proceeds along the rear surface 133L of the downstream portion 133, contaminates the flanges 142 of the reflective plate 140 and the outer surface 160S of the stay 160, and enters the support surface 160E of the stay 160.

The inclination (angle α with respect to a horizontal surface) of the inclined surface 133S, a difference (height h of the wall) in height between the bottom end (downstream end of the sliding surface 131S of the base 131) and the top end 133F, and a distance D from the bottom end to the top end 133F are set according to an estimated amount by which the lubricant overflows so that the effect of suppressing the lubricant from flowing out is maximized.

Specifically, the range of the distance D may be from 2.0 to 5.0 mm, 2.5 to 4.0 mm, 1.0 to 3.5 mm, or 0.5 to 3.0 mm. The range of the angle α may be 10 to 65 degrees, 15 to 50 degrees, 20 to 40 degrees, 15 to 30 degrees, or 5 to 30 degrees. When the distance D and angle α are determined in these ranges, a wall with a height h (=D sin α) can be provided at the downstream portion 133.

Figure 4A:
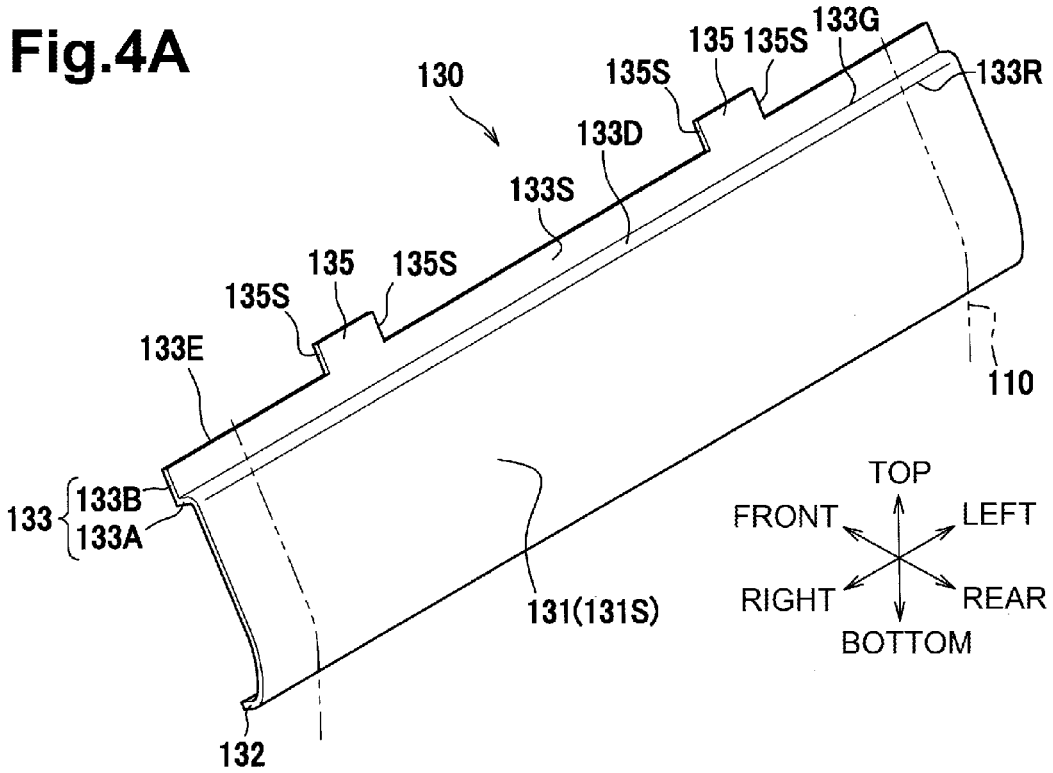
FIG. 4A is a perspective view illustrating the structure of a nip plate in a variation.
Figure 4B:
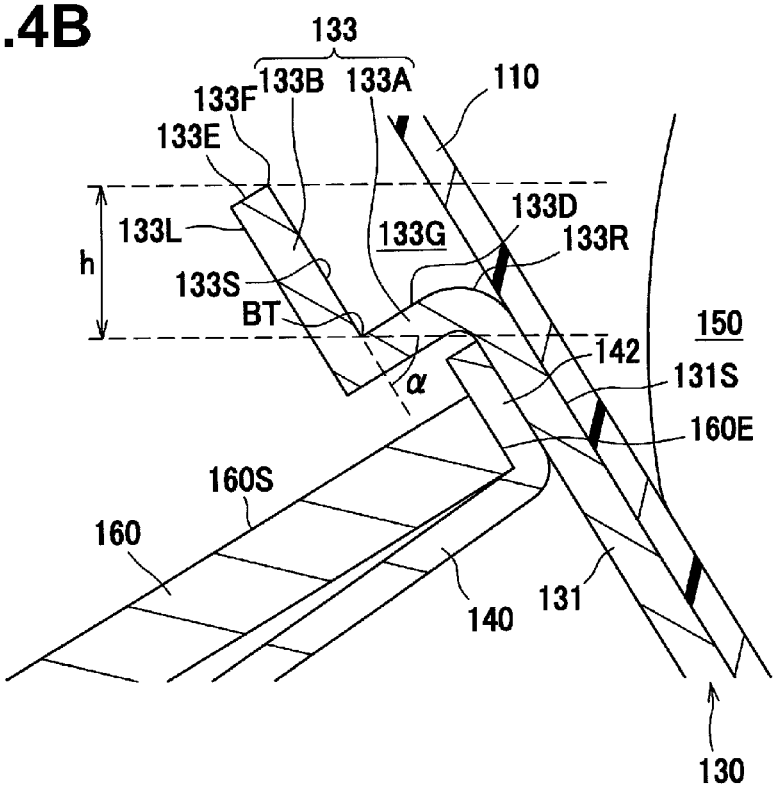
FIG. 4B is a cross sectional view illustrating a downstream portion of the nip plate and its vicinity in the fuser.

The wall formed at the downstream portion 133 of the nip plate 130 can take various variations. For example, as illustrated in FIGS. 4A and 4B, the wall may be formed by bending the downstream portion 133 downward at an angle toward the downstream side in the same way as for the conventional downstream portion and further bending the top end of the downstream portion 133 in an opposite direction.

Specifically, the downstream portion 133 has a relief portion 133A, which extends continuously from the downstream end of the base 131 in a direction away from the inner surface 110A of the endless belt 110 and also has the inclined portion 133B, which extends continuously from the top of the relief portion 133A and is disposed so that the position of the top end is higher than the position of the bottom end.

In this embodiment as well, the wall of the downstream portion 133 is formed by bending the nip plate 130. That is, the nip plate 130 is formed in such a way that the ridge 133R is formed by bending the downstream end of the base 131 in a direction away from the inner surface 110A of the endless belt 110, the base 131 is further bent at the top of the ridge 133R toward a side opposite to the ridge 133R to form a groove 133G, and the inclined portion 133B, which is an upward slope extending from the bottom BT of the groove 133G toward the top end, is formed.

Since, in this embodiment, the downstream portion 133 has the groove 133G at a position adjacent to the downstream end of the base 131, a large capacity to retain the lubricant that has overflowed from the contact portion can be obtained. Since more lubricant that has overflowed can be retained immediately near the base 131, part of the lubricant that has been temporarily stored in the groove 133G can be efficiently collected to the endless belt 110. That is, when the inner surface 110A of the endless belt 110 comes into contact with the lubricant retained in the groove 133G due to, for example, the fluttering of the endless belt 110 during driving, the lubricant can adhere to the inner surface 110A of the endless belt 110, returning the lubricant to the contact surface.

In this embodiment as well, an effect can be expected in which the inclined surface 133S of the inclined portion 133B suppresses the lubricant that is about to overflow to the outside of the downstream portion 133 from flowing out and the lubricant is returned to the groove 133G on the upstream side.

In this embodiment, the top of the inclined portion 133B is designed so that its position is higher than the position of the ridge 133R. When the downstream end of the downstream portion 133 is formed as a protrusion extending upwardly in this way and its height h is optimized, a desired effect of suppressing the lubricant from flowing out can be obtained.

In this embodiment, even if the lubricant overflows from the sliding surface 131S during the driving of the endless belt 110, the groove 133G and inclined surface 133S of the downstream portion 133 can suppress the lubricant from flowing out from the downstream portion 133. Therefore, a problem can be efficiently avoided that, for example, the lubricant proceeds over the top end 133F of the inclined surface 133S, overflows from the end surface 133E of the top end 133F and the side surface 135S of the temperature sensing tab 135, turns back and proceeds along the rear surface 133L of the downstream portion 133, contaminates the flanges 142 of the reflective plate 140 and the outer surface 160S of the stay 160, and enters the support surface 160E of the stay 160.

The depth of the groove 133G from the ridge 133R, the inclination (angle □ with respect to a horizontal surface) of the inclined surface 133S, and a difference (height h of the wall) in height between the bottom end (bottom BT of the groove 133G) and the top end 133F are set according to an estimated amount by which the lubricant overflows so that the effect of suppressing the lubricant from flowing out and the efficiency of collecting the lubricant in the groove 133G are maximized.

Specifically, the range of the height h of the wall provided in this embodiment may be, for example, 2.0 to 6.0 mm, 1.0 to 3.0 mm, 3.0 to 4.0 mm or 0.5 to 3.0 mm.

Figure 5A:
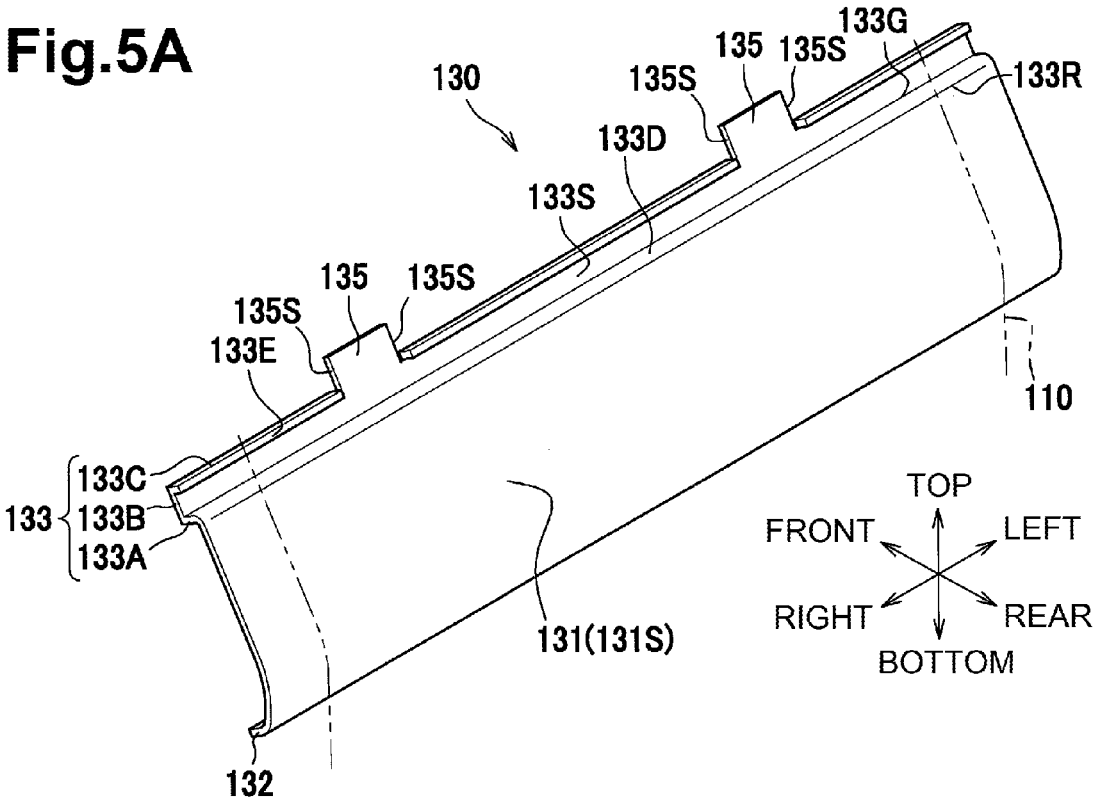
FIG. 5A is a perspective view illustrating the structure of a nip plate in another variation.
Figure 5B:
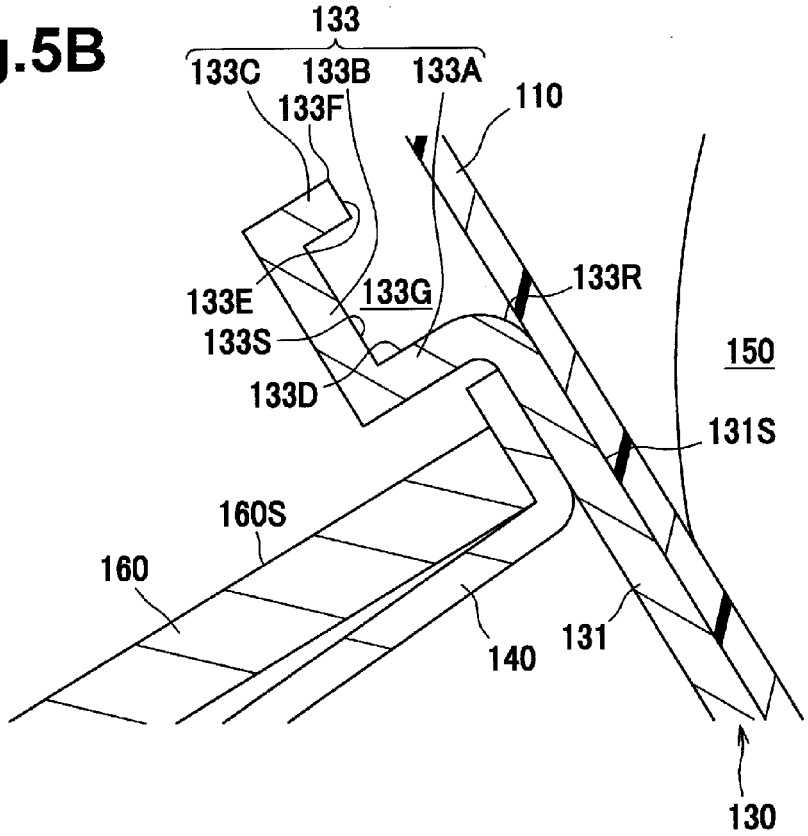
FIG. 5B is a cross sectional view illustrating a downstream portion of the nip plate and its vicinity in the fuser.

The variation illustrated in FIGS. 5A and 5B is characterized in that a protrusion 133C extending upwardly at an angle is further formed at the top of the inclined portion 133B of the nip plate 130 illustrated in FIGS. 4A and 4B by bending the downstream portion 133. Specifically, the protrusion 133C is formed by bending the downstream portion 133 at two places on a side opposite to the bent portion of the ridge 133R, which is part of the downstream portion 133 of the nip plate 130. In this embodiment, the ridge 133R is formed by bending the downstream portion 133 through about 90 degrees, after which the inclined portion 133B and the protrusion 133C are formed by bending the downstream portion 133 through about 90 degrees twice in a direction opposite to the direction in which the downstream portion 133 is bent to form the ridge 133R.

Since, in this embodiment, the protrusion 133C is formed at the downstream end of the downstream portion 133, it possible to more reliably suppress the overflowing lubricant from flowing out. Particularly in the form in FIG. 5B, the protrusion 133C protrudes at an angle in a direction toward the endless belt 110, so an effect can be expected in which the lubricant extruded by the endless belt 110 is efficiently blocked and is returned.

The direction in which the protrusion 133C extends and its height are set according to an estimated amount by which the lubricant overflows so that the effect of suppressing the lubricant from flowing out and the efficiency of collecting the lubricant in the groove 133G are maximized, together with the depth of the groove 133G from the ridge 133R, the inclination of the inclined surface 133S, and the height of its top. To suppress the lubricant from turning back at the edge of the protrusion 133C, entering the rear surface, and flowing out, the end of the protrusion 133C is placed so as not to come into contact with the inner surface 110A of the endless belt 110 during normal driving.

Figure 6A:
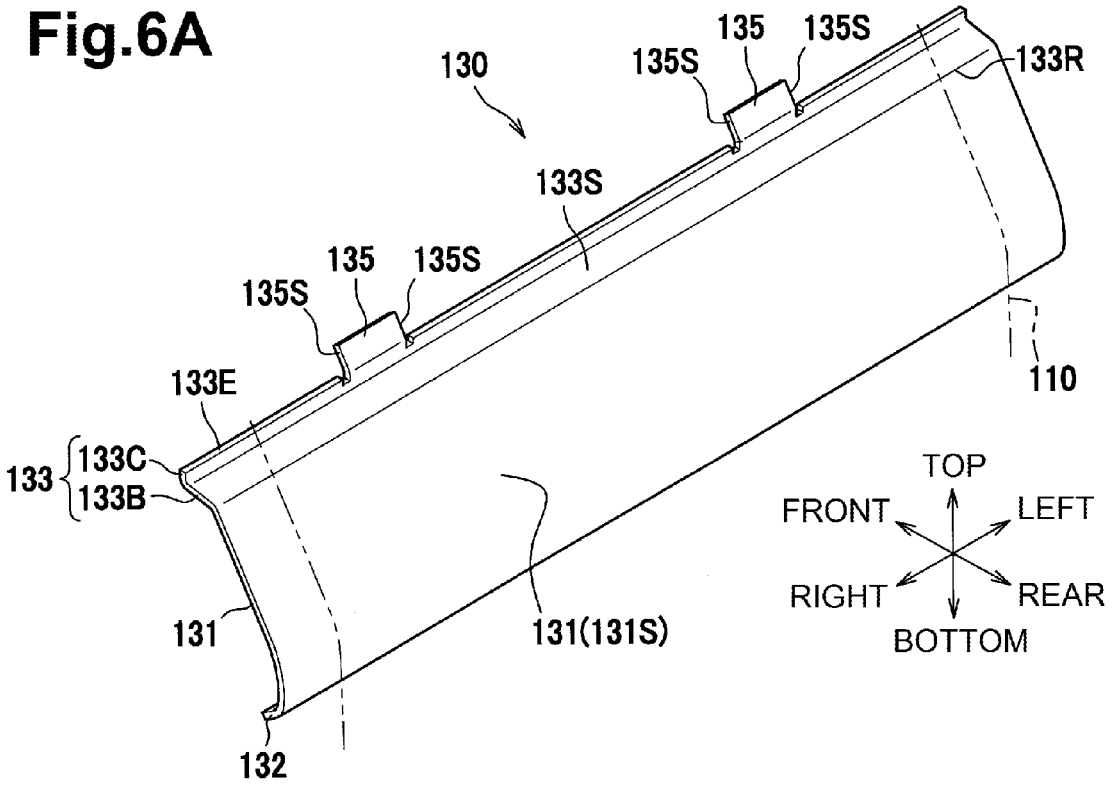
FIG. 6A is a perspective view illustrating the structure of a nip plate in yet another variation.
Figure 6B:
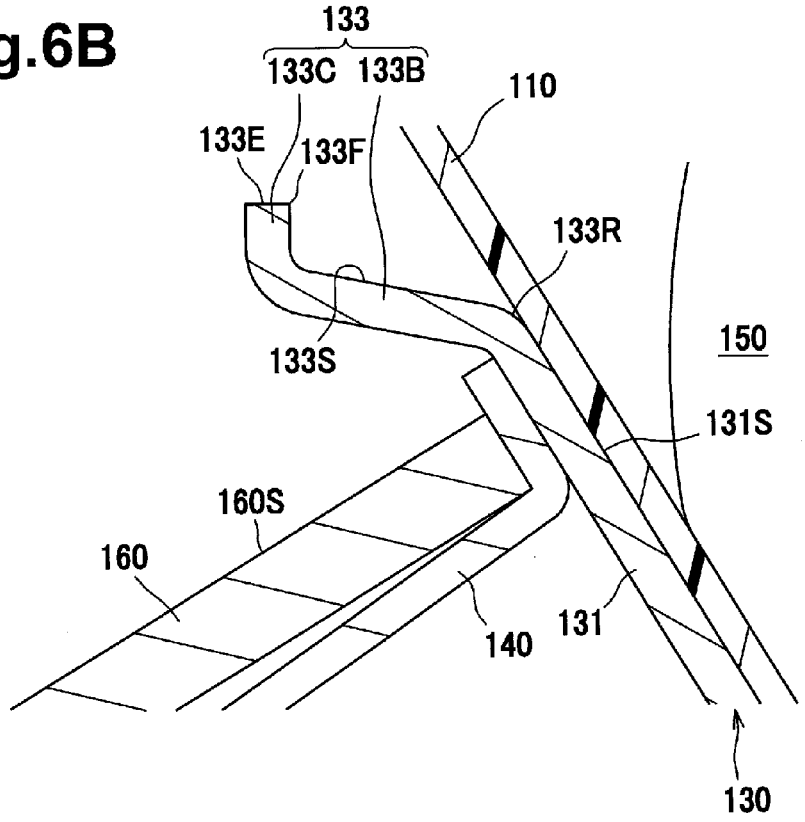
FIG. 6B is a cross sectional view illustrating a downstream portion of the nip plate and its vicinity in the fuser.

A variation illustrated in FIGS. 6A and 6B is characterized in that the protrusion 133C extending upwardly is further formed at the top of the inclined portion 133B of the nip plate 130 illustrated in FIGS. 3A and 3B by bending the downstream portion 133. This variation lacks the relief portion 133A (groove 133G) included in the nip plate 130 illustrated in FIGS. 4A, 4B, 5A, and 5B. Specifically, the protrusion 133C is formed by bending the downstream portion 133 once in a direction opposite to the direction in which the ridge 133R, which is part of the downstream portion 133 of the nip plate 130, is bent.

In this embodiment as well, the inclined surface 133S is formed so as to continuously extend upwardly from the ridge 133R formed at the downstream end of the base 131 toward the downstream side, an effect can be expected in which the lubricant that is about to overflow from the downstream portion 133 is returned to the base 131 due to the gravity.

Furthermore, in this embodiment, since the protrusion 133C extending upwardly is formed at the downstream end of the downstream portion 133, it possible to more reliably suppress the overflowing lubricant from flowing out.

The direction in which the protrusion 133C extends and its height are set according to an estimated amount by which the lubricant overflows in consideration of the effect of suppressing the lubricant from flowing out, together with the inclination of the inclined surface 133S and the height of its top. As in the form illustrated in FIGS. 5A and 5B, to suppress the lubricant from turning back at the edge of the protrusion 133C, entering the rear surface, and flowing out, the end of the protrusion 133C is placed so as not to come into contact with the inner surface 110A of the endless belt 110 during normal driving.

So far, a typical embodiment of the present invention and its several variations have been described, but the present invention is not limited to the embodiment and variations. For specific structures, many variations can be appropriately made without departing from the intended scope of the present invention.

Although, in the above embodiment, an aspect has been exemplified in which the wall of the downstream portion 133 is positioned at a position higher than the position of the ridge 133R formed on the boundary between the base 131 and the downstream portion 133, this is not a limitation. It is also possible to position the top of the wall (end of the inclined portion 133B or end of the protrusion 133C) at a position lower than the position of the ridge 133R by forming the relief portion 133A (groove 133G) to prevent a contact with the inner surface 110A of the endless belt 110 during normal driving. Even if the base 131 faces upward in a substantially perpendicular direction, a desired effect of suppressing the lubricant from flowing out can be obtained by adjusting the depth of the groove 133G and the angle or length of the inclined portion 133B.

Although, in the above embodiment, a structure in which the downstream portion 133 includes the inclined portion 133B having the inclined surface 133S, which is substantially flat, has been described with reference to drawings, this is not a limitation. The inclined surface 133S may not be flat or the downstream portion 133 may not have the inclined surface 133S. That is, a wall (relief portion 133A) having the effect of suppressing the lubricant from flowing out can be formed by forming the groove 133G with the relief portion 133A and the protrusion 133C extending upwardly at the downstream portion 133.

Although, in the above embodiment, the halogen lamp 120 has been used as the heat source (heater) of the fuser 100 to emit radiant heat to heat the endless belt 110 through the nip plate 130 and thereby to heat toner on a sheet S, this is not a limitation to the heat source of the fuser 100. Any heat source can be used if it can directly or indirectly heat a belt. Examples of the heat source include heating bodies, such as carbon heaters and ceramic heaters, and IH heaters and other heaters that do not generate heat but can heat a metal belt, a nip plate, and the like by an electromagnetic induction heating method. The type and placement of a heat source can be appropriately selected.

Figure 7A:
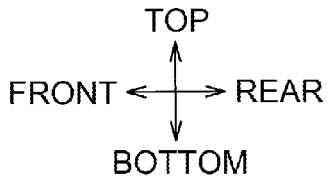
FIG. 7A is a cross sectional view illustrating a nip plate and its vicinity in the fuser in a variation.
Figure 7A:
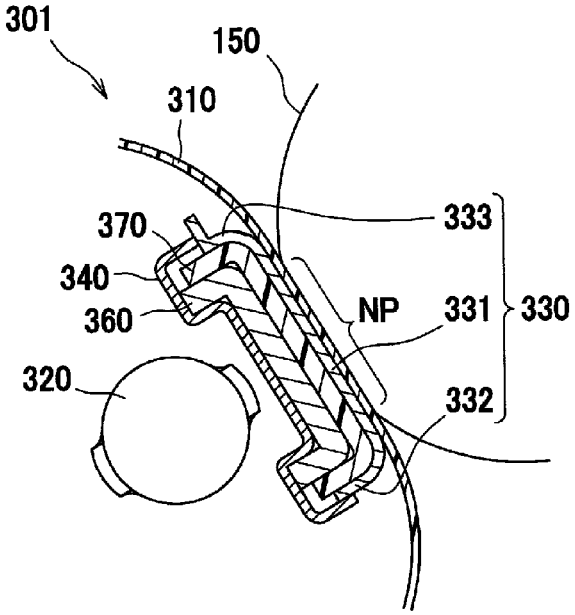

The heating member 101 of the fuser 100 can also have a structure in various variations. For example, a heating member 301 illustrated in FIG. 7A has a structure in which an adiabatic resin member 370 is interposed between a halogen lamp 320 and a nip plate 330 so that radiant heat emitted from the halogen lamp 320 can be directed to an endless belt 310 directly or through a reflective plate 340 (without involving the nip plate 330). The stay 360 in FIG. 7A supports the nip plate 330 and reflective plate 340.

Figure 7B:
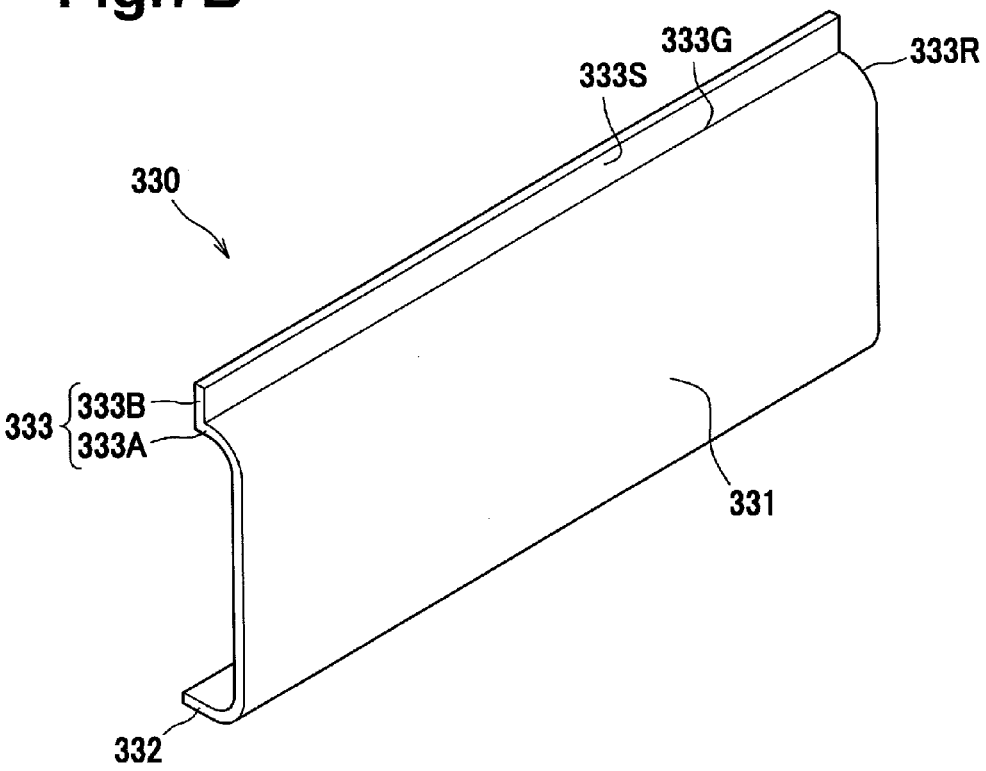
FIG. 7B is a perspective view illustrating the structure of the nip plate.

This nip plate 330 can also achieve a desired effect of suppressing the lubricant from flowing out as the form illustrated in FIGS. 4A and 4B by, for example, forming a downstream portion 333, which does not come into contact with the inner surface of the endless belt 310, with a relief portion 333A, an inclined portion 333B, a groove 333G, and an inclined surface 333S as illustrated in, for example, FIG. 7B.

Although, in the above embodiment, the walls (structural members that prevent the lubricant from flowing out) of the downstream portions 133 and 333 have been disposed across the bases 131 and 331 of the nip plates 130 and 330 in the longitudinal direction (in the direction of the rotational axis lines of the endless belts 110 and 310), this is not a limitation to the present invention. If the walls of the downstream portions 133 and 333 are disposed at least across a range corresponding to the widths of the endless belts 110 and 310, it is possible to suppress the lubricant overflowing from flowing out with the driving endless belts 110 and 310.

Although, in the above embodiment, the nip plate 130 has been exemplified as a nip forming assembly, this is not a limitation to the present invention; for example, the nip plate 130 may be formed like a block or a pad, rather than a plate. That is, although, in the above embodiment, the base 131 and downstream portion 133 have been formed by bending the nip plate 130, the contact portion of the nip forming assembly only needs to have a surface (that is, a contact portion) placed so as to come into contact with the inner surface 110A of the endless belt 110 with a lubricant intervening therebetween. The downstream portion only needs to extend from the downstream end of this contact portion and to be placed at a distance from the inner surface 110A of the endless belt 110. The nip member may be formed with a ceramic heater that doubles as the heat source described above.

Figure 8A:
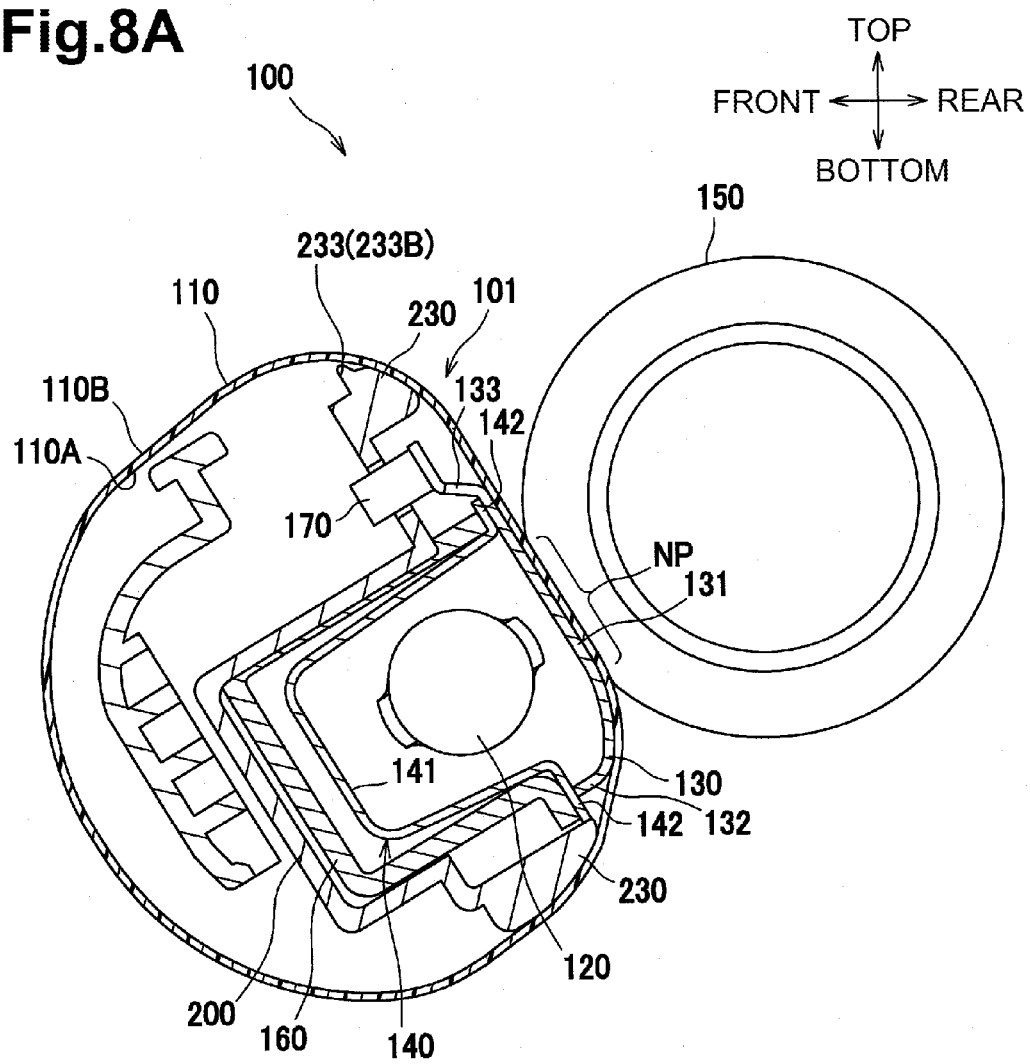
FIG. 8A is a cross sectional view illustrating the fuser in another variation.
Figure 8B:
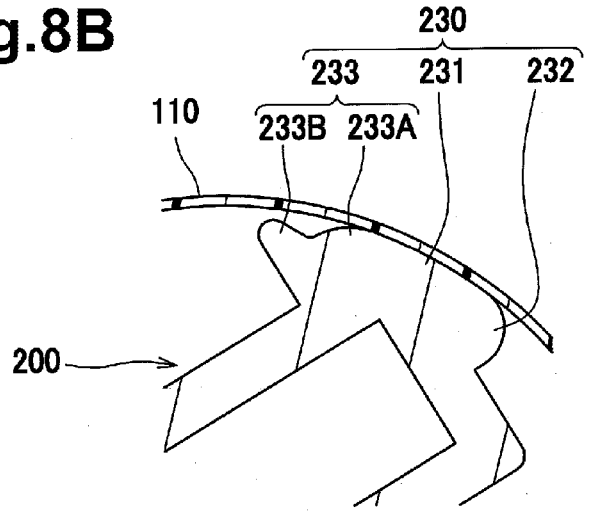
FIG. 8B is an enlarged cross sectional view illustrating part of the structure of a guide.

FIGS. 8A and 8B illustrate a form in which a contact portion is formed on the guide member placed on the downstream side of the nip member of the nip forming assembly. In this example, as illustrated in FIG. 8A, the downstream portion structure of the nip plate 130 is the same as in the embodiment illustrated in FIGS. 3A and 3B, and the wall in the present invention, which is placed so that the top end is at a position higher than the position of the bottom end, is provided on the guide 230 on the downstream side of the guide frame 200, which is part of the nip forming assembly.

Specifically, as illustrated in FIG. 8B, the guide 230 includes a base 231 (contact portion), which comes into contact with the inner surface 110A of the endless belt 110 with the lubricant intervening therebetween during driving, and also includes and an upstream portion 232 and a downstream portion 233, which respectively extend from the upstream end and downstream end of the base 231 in a sliding direction. The downstream portion 233 includes a relief portion 233A and an inclined portion 233B.

Even if the guide 230 is structured in this way, the effect of suppressing the lubricant from flowing out and some other effects of the present invention can be obtained as in the form illustrated in FIGS. 4A and 4B. It is also possible to eliminate, from the nip member (nip plate 130), the downstream portion 133, which has been placed at a distance from the inner surface 110A of the endless belt 110, by placing the guide 230 next to the nip member without a clearance therebetween. In this case, the structure in the present invention can be formed in the downstream portion 233 extending from the downstream end of the contact portion of the guide 230 contiguous to the nip member.

Although, in the above embodiment, the photosensitive drum 41 has been exemplified as the image supporting body, this is not a limitation to the present invention. For example, the image supporting body may be an intermediate transfer drum or an intermediate transfer belt that is structured so as to be capable of supporting a toner image transferred from a photosensitive drum.

Although, in the above embodiment, the sheet S, which is a thick sheet, a postcard, a thin sheet, or the like, has been exemplified as the recording sheet, this is not a limitation to the present invention. For example, the recording sheet may be an overhead projector (OHP) sheet.

Although, in the above embodiment, the laser printer 1 has been exemplified as the image forming apparatus, this is not a limitation to the present invention. For example, the image forming apparatus may be a copier, such as a flatbed scanner, or multi-function peripheral that has a document reading apparatus.

What is claimed is:

1. An image forming apparatus comprising:

a main body having a bottom surface, wherein the main body accommodates:

a photosensitive drum disposed away from the bottom surface; and a fuser having at least a portion disposed further away from the bottom surface than the photosensitive drum is to the bottom surface, the fuser comprising:

an endless belt;

a rotatable body; and a nip plate comprising:

a first surface with lubricant thereon that faces an inner surface of the endless belt, the first surface and the rotatable body being configured to nip the endless belt therebetween, the endless belt and the rotatable body configured to form a nip therebetween; and a second surface that extends from an end of the first surface, the second surface including a furthest downstream portion of the nip plate along a conveying path of a sheet at the nip, and being spaced apart from the inner surface of the endless belt, wherein the second surface includes a first portion inclined from the end of the first surface toward the bottom surface of the image forming apparatus to an end of a second portion of the second surface, the second portion being inclined away from the bottom surface.

2. The image forming apparatus according to claim 1, wherein the second surface is configured to return the lubricant toward the first surface by gravity, the second surface having an area which has a length the same as a width of endless belt.

3. The image forming apparatus according to claim 1, further comprising a support protruding from the bottom surface of the main body.

4. The image forming apparatus according to claim 3, wherein the support is softer than the bottom surface of the main body.

5. The image forming apparatus according to claim 3, wherein the support includes gum.

6. The image forming apparatus according to claim 1, further comprising a plurality of supports protruding from the bottom surface of the main body.

7. The image forming apparatus according to claim 6, wherein each of the plurality of supports is softer than the bottom surface of the main body.

8. The image forming apparatus according to claim 6, wherein each of the plurality of supports includes gum.

9. The image forming apparatus according to claim 6, wherein the second surface of the nip plate is inclined relative to both the first surface and an imaginary line tangent to a bottom surface of two of the plurality of supports.

10. The image forming apparatus according to claim 1, further comprising a supply tray configured to be closer to the bottom surface than the photosensitive drum is to the bottom surface.

11. The image forming apparatus according to claim 1, wherein the first surface and the second surface face away from the bottom surface of the image forming apparatus.

12. The image forming apparatus according to claim 1, wherein the second surface of the nip plate is inclined relative to both the first surface and an extending direction of the bottom surface.

13. The image forming apparatus according to claim 1, wherein the nip plate comprises a metal plate.

14. The image forming apparatus according to claim 1, wherein the second surface includes a third portion protruding from the end of the second portion toward the endless belt.

15. An image forming apparatus comprising:

a main body having a bottom surface;

a photosensitive body disposed away from the bottom surface inside the main body;

a fuser disposed further away from the bottom surface than the photosensitive body is to the bottom surface inside the main body, the fuser comprising:

an endless belt;

a heater extending inside the endless belt;

a rotatable body; and a nip plate comprising:

a first surface with lubricant thereon that faces an inner surface of the endless belt, the first surface and the rotatable body being configured to nip the endless belt therebetween, the endless belt being configured to move in a moving direction at the nip; and a second surface that extends from an end of the first surface, the second surface including a furthest downstream portion of the nip plate in the moving direction, and being spaced apart from the inner surface of the endless belt; and a guide for guiding an inner peripheral surface of the endless belt, the guide being disposed further away from the bottom surface than the second surface of the nip plate to the bottom surface, the guide protruding in a direction from the nip plate toward the rotatable body beyond at least a portion of the second surface of the nip plate.

16. The image forming apparatus according to claim 15, wherein the nip plate comprises a metal plate.

17. The image forming apparatus according to claim 16, wherein the main body further comprises a foot disposed on the bottom surface.

18. The image forming apparatus according to claim 17, wherein the foot comprises gum.

19. The image forming apparatus according to claim 15, wherein a portion of the endless belt is bridged by the first surface of the nip plate and the guide, the portion of the endless belt being spaced apart from the second surface of the nip plate.

20. The image forming apparatus according to claim 15, wherein the second surface includes a first portion inclined from the end of the first surface toward the bottom surface of the image forming apparatus to an end of a second portion of the second surface, the second portion being inclined away from the bottom surface.

21. An image forming apparatus comprising:

a main body having a bottom surface;

a photosensitive body disposed away from the bottom surface inside the main body; and a fuser disposed further away from the bottom surface than the photosensitive body to the bottom surface inside the main body, the fuser comprising:

an endless belt;

a heater extending inside the endless belt;

a rotatable body; and a nip forming assembly comprising:

a first surface with lubricant thereon that faces an inner surface of the endless belt, the first surface and the rotatable body being configured to nip the endless belt therebetween, the endless belt being configured to move in a moving direction at the nip, the first surface facing away from the bottom surface and being inclined relative to an imaginary plane perpendicular to the bottom surface; and a second surface that extends from an end of the first surface, the second surface including a downstream end in the moving direction, and being spaced apart from the inner surface of the endless belt, the second surface having a first inclined portion inclined relative to the first surface and extending away from the bottom surface and having a second inclined portion inclined from the end of the first surface toward the bottom surface of the image forming apparatus to the first inclined portion.

22. The image forming apparatus according to claim 21, wherein the main body further comprises a foot disposed on the bottom surface.

23. The image forming apparatus according to claim 22, wherein the foot comprises gum.

24. The image forming apparatus according to claim 21, wherein the furthest downstream portion of the second surface is disposed further away from the bottom surface than the first surface.

* * * * *